US005810356A

United States Patent [19]

Green

[11] Patent Number: 5,810,356

[45] Date of Patent: Sep. 22, 1998

[54] VARIABLE BOUNDARY JIGSAW PUZZLE

[75] Inventor: David Green, Haifa, Israel

[73] Assignee: Conceptis Ltd., Haifa, Israel

[21] Appl. No.: 880,528

[22] Filed: Jun. 23, 1997

[51] Int. Cl.[6] ..... A63F 9/10

[52] U.S. Cl. ..... 273/157 R; 463/9

[58] Field of Search ..... 273/157 R, 153 R, 273/153; 463/9

[56] References Cited

U.S. PATENT DOCUMENTS

| | | | |
|---|---|---|---|
| 5,296,845 | 3/1994 | Haller | 273/157 R |
| 5,465,982 | 11/1995 | Rebane | 463/9 |
| 5,605,332 | 2/1997 | Harnett | 273/157 R |

OTHER PUBLICATIONS

Jasmine Multimedia, "Vid Grid", pp. 1–6, 1994.

Jonathan Bell, "VidGrid not just Multimedia Trash", The Daily Beacon, pp. 1–2, Sep. 1994.

*Primary Examiner*—Steven B. Wong

*Attorney, Agent, or Firm*—Mark M. Friedman

[57] ABSTRACT

A puzzle includes a display showing a plurality of pieces, each of the pieces corresponding substantially to a given region of a composite block, and an input device for allowing a user to manipulate the position of at least some of the pieces so as to construct the composite block. Pieces corresponding to adjacent regions of the composite block have complementary boundaries. A visible property of the complementary boundaries varies with time such that, at any instant, the complementary boundaries between pieces corresponding to adjacent regions of the composite block have matching visible properties. Typically, the variable visible property is the shape of the boundary. Alternatively, it may be a graphic element moving along the boundary.

7 Claims, 4 Drawing Sheets

VARIABLE BOUNDARY JIGSAW PUZZLE

FIELD AND BACKGROUND OF THE INVENTION

The present invention relates to computer games and, in particular, it concerns a jigsaw-type puzzle in which the pieces have dynamically varying boundaries.

It is known to provide computer games which simulate the traditional jigsaw puzzle. Such games show a visual representation of pieces on a screen. The pieces are then moved through conventional computer inputs such as a mouse so as to fit together on the screen. Each piece typically carries a part of a picture which, when correctly fitted together, matches with the parts on adjacent pieces to form an entire picture. The picture usually provides visual clues to help in correct positioning of the pieces.

The boundaries of the pieces may include lobes and recesses similar to those of the traditional jigsaw puzzle. Alternatively, simple rectangular tiles may be used, the picture serving as the only clue for correct matching of the pieces. However, in all cases known to the inventor, the boundaries of the pieces are pre-fixed in a particular form and do not vary during playing of the game.

There is therefore a need for a computer jigsaw puzzle in which the boundaries of the pieces vary dynamically during the game.

SUMMARY OF THE INVENTION

The present invention is a computer jigsaw puzzle made up of pieces with dynamically varying boundaries.

According to the teachings of the present invention there is provided, a puzzle comprising: (a) a display showing a plurality of pieces, each of the pieces corresponding substantially to a given region of a composite block, ones of the pieces corresponding to adjacent regions of the composite block having complementary boundaries which can be juxtaposed to form a composite block; and (b) an input device for allowing a user to manipulate the position of at least some of the pieces so as to juxtapose the complementary boundaries of the pieces to construct the composite block, wherein a visible property of the complementary boundaries varies with time such that, at any instant, the complementary boundaries between ones of the pieces corresponding to adjacent regions of the composite block have matching visible properties.

According to a further feature of the present invention, the visible property is shape.

According to a further feature of the present invention, the shape varies such that, at any instant, the complementary boundaries between ones of the pieces corresponding to adjacent regions of the composite block fit closely together.

According to a further feature of the present invention, the shape varies such that, if the complementary boundaries between ones of the pieces corresponding to adjacent regions of the composite block were to be placed together, the boundaries would feature a geometrical motif outlined by matching recesses progressing along the boundaries.

According to a further feature of the present invention, the geometrical motif itself varies with time.

According to a further feature of the present invention, the shape varies so as to correspond to a pattern traveling along the boundaries.

According to a further feature of the present invention, the shape is made up from a plurality of straight line segments.

There is also provided according to the teachings of the present invention, a puzzle comprising: (a) a display showing a plurality of pieces, each of the pieces corresponding substantially to a given region of a composite block, ones of the pieces corresponding to adjacent regions of the composite block having complementary boundaries which can be juxtaposed to form a composite block; and (b) an input device for allowing a user to manipulate the position of at least some of the pieces so as to juxtapose the complementary boundaries of the pieces to construct the composite block, wherein the shape of the complementary boundaries varies with time such that, at any instant, the complementary boundaries between ones of the pieces corresponding to adjacent regions of the composite block have matching shapes.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a computer jigsaw puzzle made up of pieces with dynamically varying boundaries.

The principles and operation of puzzles according to the present invention may be better understood with reference to the drawings and the accompanying description.

Figure 1:
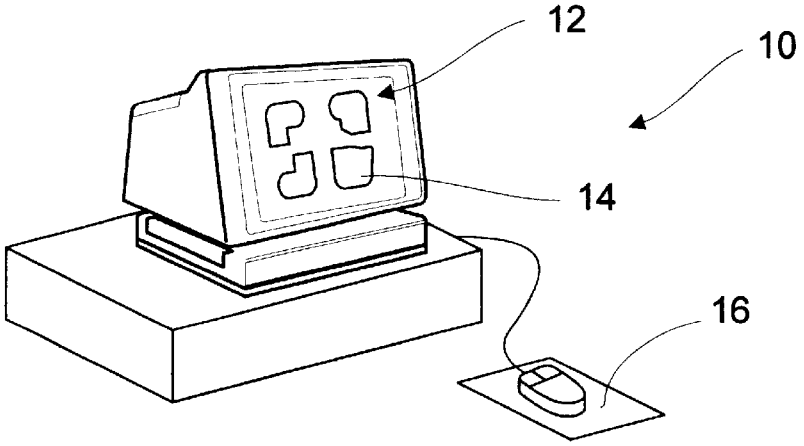
FIG. 1 is a schematic perspective view of a puzzle system, constructed and operative according to the teachings of the present invention.

Referring now to the drawings, a first implementation of a puzzle, generally designated 10, constructed and operative according to the teachings of the present invention, will be described with reference to FIGS. 1–3. Generally speaking, puzzle 10 includes a display 12 showing a plurality of pieces 14. An input device 16 allows a user to manipulate the position of at least some of the pieces 14 so as to juxtapose them to construct a composite block.

Figure 2A:
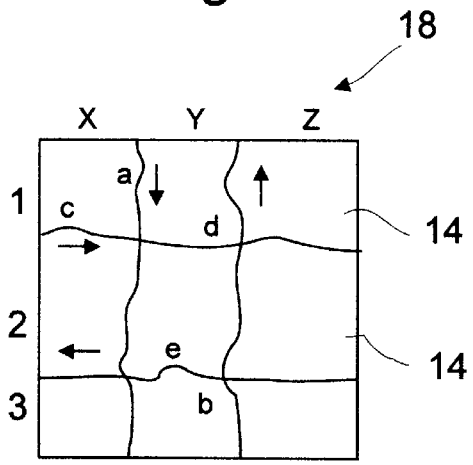
FIG. 2A is a schematic illustration of the pieces of a first implementation of a puzzle, constructed and operative according to the teachings of the present invention, in its assembled state and at a first time $t_1$.
Figure 2B:
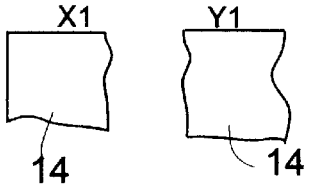
FIG. 2B is a schematic illustration of two pieces from the puzzle of FIG. 2A in a separated state.

Each piece 14 corresponds substantially to a given region of the composite block, represented by block 18 shown in FIG. 2A. Pieces corresponding to adjacent regions of composite block 18 have complementary boundaries, i.e., boundaries which match and fit together. An example of two such pieces is shown in FIG. 2B.

It is a particular feature of the present invention that some visible property of the complementary boundaries varies with time such that, at any instant, complementary boundaries between pieces corresponding to adjacent regions of the composite block have matching visible properties. Typically, the variable visible property is the shape of the boundary.

Typically, pieces 14 do not contain any picture prior to their assembly. Instead, the variable properties of the piece boundaries provide visual clues momentary shapes, contours and motions—which must be used to identify which pieces fit together. Alternatively, a still picture, a moving video image or any other graphic element may be subdivided between the surfaces of the pieces in accordance with the corresponding regions of the composite block.

Figure 3A:
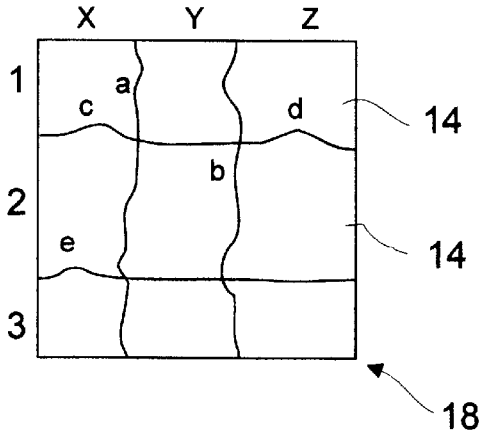
FIG. 3A is a schematic illustration of the pieces of the puzzle of FIG. 2A in its assembled state and at a second time $t_2$.
Figure 3B:
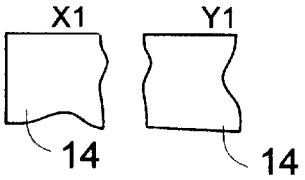
FIG. 3B is a schematic illustration of two pieces from the puzzle of FIG. 3A in a separated state.
Figure 4A:
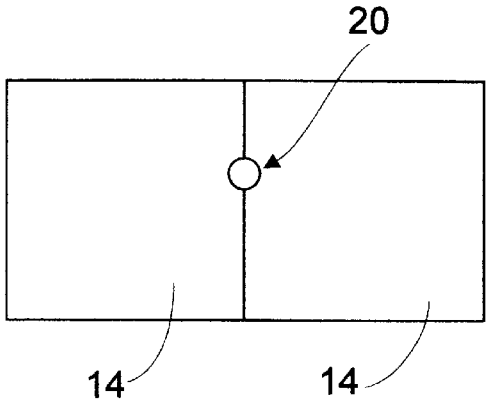
FIG. 4A is a schematic illustration of the pieces of a second implementation of a puzzle, constructed and operative according to the teachings of the present invention, in its assembled state and at a first time $t_1$.
Figure 4B:
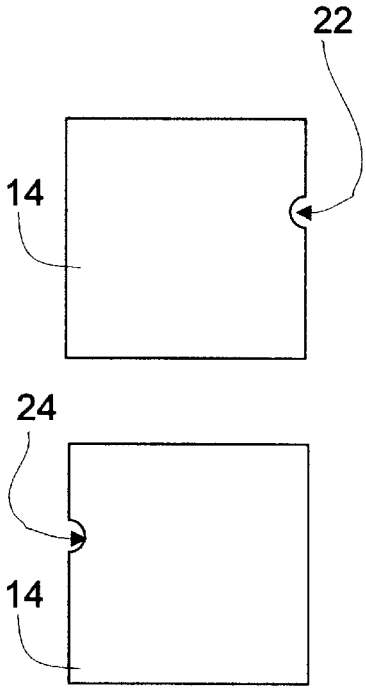
FIG. 4B is a schematic illustration of two pieces from the puzzle of FIG. 4A in a separated state.
Figure 5A:
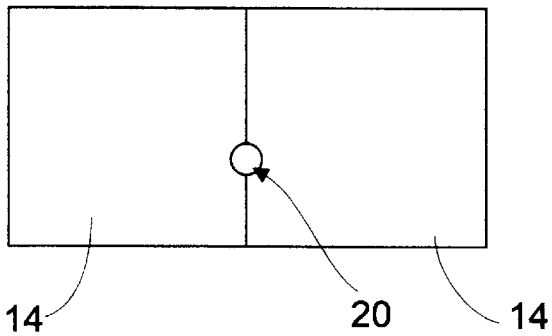
FIG. 5A is a schematic illustration of the pieces of the puzzle of FIG. 4A in its assembled state and at a second time $t_2$.
Figure 5B:
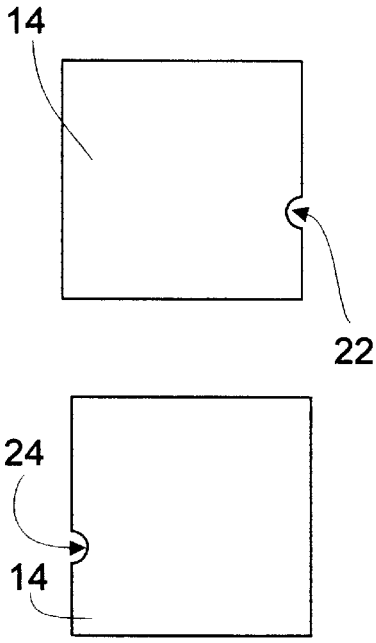
FIG. 5B is a schematic illustration of two pieces from the puzzle of FIG. 5A in a separated state.

An example of the time variation of the present invention will now be described in more detail with reference to FIGS. 2A, 2B, 3A and 3B. FIG. 2A shows an assembled composite block 18 made up of a 3×3 grid of pieces 14 at a first time $t_1$. The columns and rows of the grid are identified by letters and numbers, respectively, so that each piece can be identified by its coordinates (Xl, X2, . . . ). FIG. 2B shows two separate pieces 14 corresponding to adjacent regions X1 and Y1 of block 18, also at time $t_1$. FIGS. 3A and 3B are corresponding views taken a short time later at time $t_2$.

In this example, the boundaries between adjacent rows and adjacent columns are shaped as irregular patterns of curves. When the pieces are viewed separately as in FIG. 2B, these curves correspond to complementary patterns of projections and recesses along the boundaries of the pieces.

The time variation of this example is implemented as progression of the pattern of curves along the length of the boundary. Thus, a feature designated in FIG. 2A by a progresses downwards as indicated by an arrow along the boundary between columns X and Y. As a result, at time $t_1$ (FIG. 2A), feature a lies between the upper parts of pieces X1 and Y1, whereas at time $t_2$ (FIG. 3A), it has progressed to between the lower of these pieces. Similarly, features denoted b, c, d and e progress along the other boundaries in the directions shown by the arrows.

FIGS. 2B and 3B show the shapes of individual pieces 14 at times $t_1$ and $t_2$. The effect of the progression of features along the boundaries is that the boundary shape of each piece varies dynamically. However, at each instant, pieces corresponding to adjacent regions of the composite block have complementary shaped borders such that they can fit closely together.

It should be appreciated that the patterns may progress in opposite directions and at different speeds along different boundaries. Furthermore, for any given boundary, the pattern may reverse or oscillate its direction of movement. The patterns themselves may be pre-defined repetitive patterns or mathematically defined functions, with or without a random parameter.

Further possible implementations of boundary patterns for adjacent pieces 14 are illustrated in FIGS. 4–9. FIGS. 4A, 4B, 5A and 5B show an example in which a geometrical motif in the composite block, in this case a circle 20, is outlined by matching recesses 22 and 24 progressing along the boundaries of the adjacent pieces.

Figure 6:
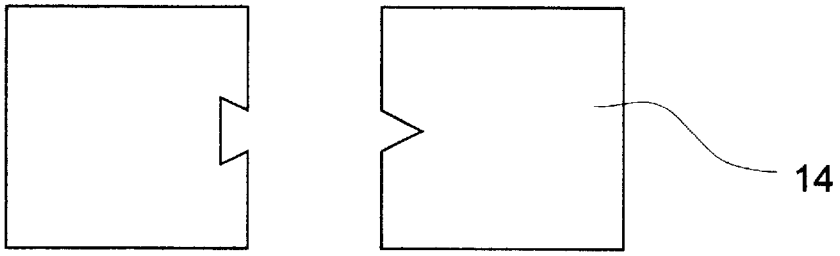
FIG. 6 is a schematic illustration of two pieces from a third implementation of a puzzle, constructed and operative according to the teachings of the present invention.

FIG. 6 illustrates a similar example in which a geometrical motif appears as a graphic element split between two adjacent pieces and traveling along the boundary. This case may be regarded as a selectively thickened region of the border itself such that the thickened regions of the two adjacent pieces together form a graphic element.

Figure 7:
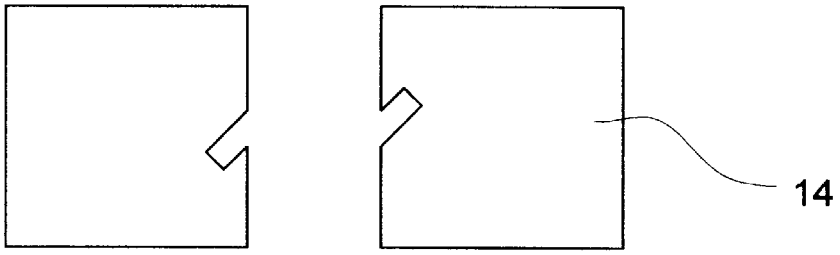
FIG. 7 is a schematic illustration of two pieces from a fourth implementation of a puzzle, constructed and operative according to the teachings of the present invention.

FIG. 7 shows an example similar to FIGS. 4 and 5 in which the matching recesses are asymmetric.

Figure 8:
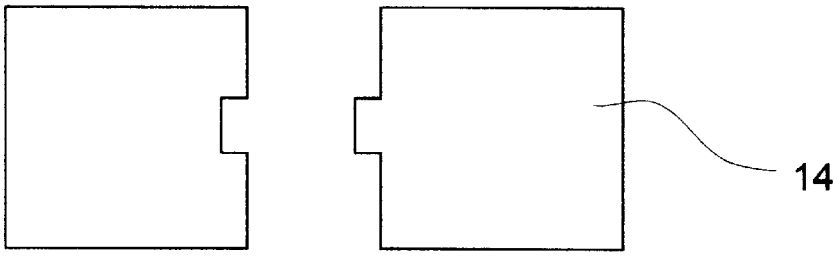
FIG. 8 is a schematic illustration of two pieces from a fifth implementation of a puzzle, constructed and operative according to the teachings of the present invention.
Figure 9:
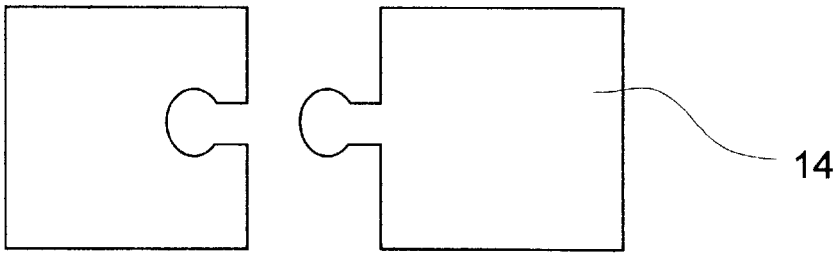
FIG. 9 is a schematic illustration of two pieces from a sixth implementation of a puzzle, constructed and operative according to the teachings of the present invention.

FIGS. 8 and 9 show examples of interlocking patterns with square and keyhole-type projections and recesses, respectively.

It should be noted that, in any of the above examples, the time variation is not limited to progression of a constant pattern along the boundaries. Instead, or in addition, the shape, size, color, or any other attribute of the pattern itself may vary with time.

It should also be appreciated that the changing features of the boundaries cause associated changes in the relative sizes of the pieces. In certain implementations, the entire boundary may shift sufficiently such that the pieces corresponding to an entire row or column becomes extinct. Conversely, a new row or column may be generated by splitting of a boundary into two parts. New pieces generated in this manner are positioned in a manner similar to the initial scattering of pieces which will be described below.

Figure 10:
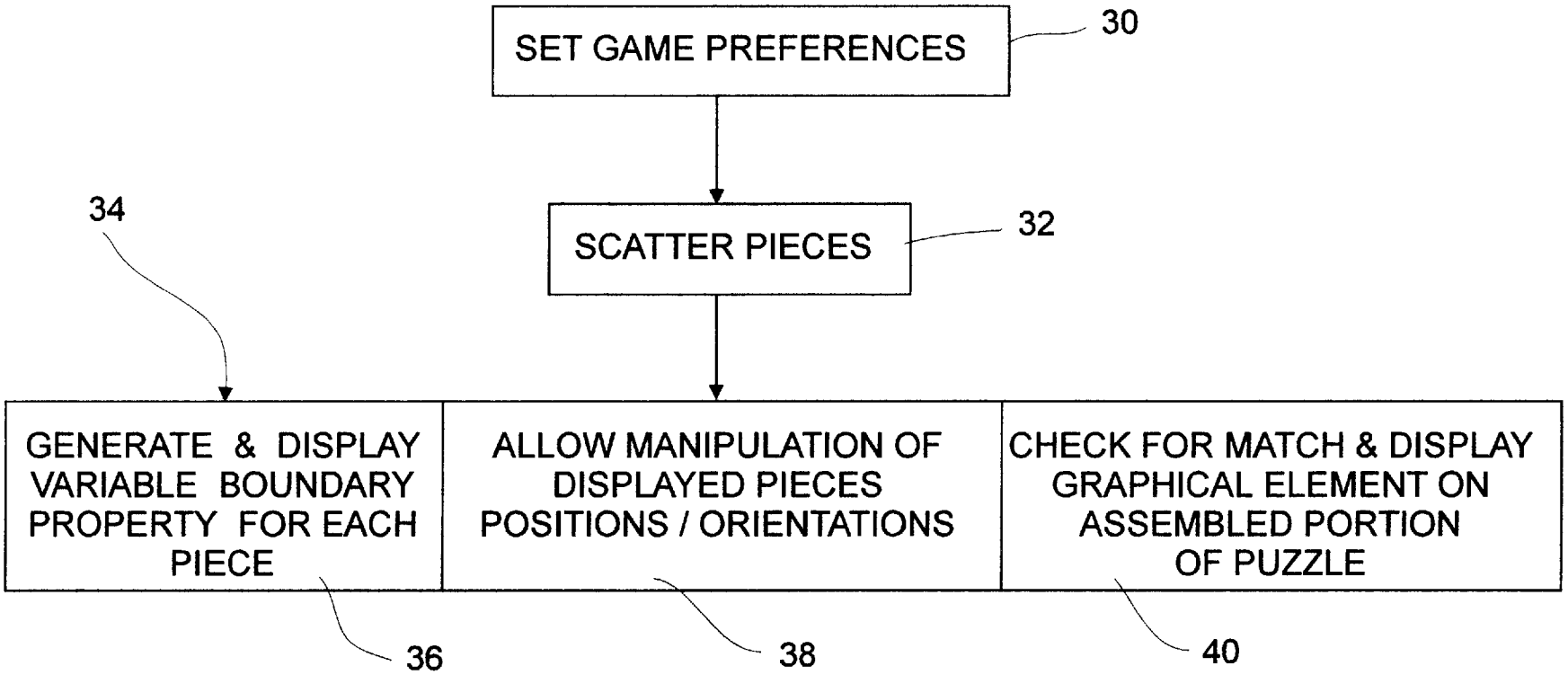
FIG. 10 is a flow diagram illustrating a possible mode of operation of a puzzle according to the teachings of the present invention.

Turning now to FIG. 10, the operation of a typical implementation of puzzle 10 will now be described. First, a range of game preferences may be set (step 30). These preferences dictate the level of difficulty of the puzzle, as well as a number of aesthetic features. Typically, the preferences include the number of pieces making up the puzzle, the type or types of border shapes to be used, and the speed of border variation. The user may also have control over whether the pieces undergo rotation during initial scattering. Various graphic and sound effects may also be set.

Then, at step 32, the initial puzzle layout is defined by a scattering process. The scattering process designates an initial position for each piece. Typically, the initial positions are randomly generated. Where angular rotation is allowed, an initial angular orientation is also generated.

Operation of the puzzle then proceeds with block 34 which includes a number of sub-routines operating more or less concurrently. In a first sub-routine 36, the variable boundary is generated so that its visible properties vary in accordance with the parameters set in step 30 and the appropriate section of the boundary is displayed along the border of each piece in its present position and orientation. This sub-routine continues substantially uninterrupted throughout operation of the puzzle.

In parallel with sub-routine 36 is a further sub-routine 38 which allows manipulation of the displayed pieces by a user. The manipulation, typically performed by a mouse or other conventional user interface, includes translation of the pieces' positions and, where applicable, rotation of pieces.

A further sub-routine 40 identifies when pieces have been aligned correctly within a given margin of error and then "snaps and glues" them together as a part of the composite block. Preferably, as pieces are assembled together, a video movie, a picture or some other graphical element is revealed on the assembled portion of the composite block. This provides an aesthetic incentive for completion of the puzzle to reveal the entire view of the graphic. According to the user preferences, the varying boundaries may either continue to be displayed after assembly, or may disappear as part of the "gluing" effect when pieces are attached.

It will be appreciated that the above descriptions are intended only to serve as examples, and that many other embodiments are possible within the spirit and the scope of the present invention.

What is claimed is:

1. A puzzle comprising:

(a) a display showing a plurality of pieces, each of said pieces corresponding substantially to a given region of a composite block, ones of said pieces corresponding to adjacent regions of said composite block having complementary boundaries which can be juxtaposed to form a composite block; and (b) an input device for allowing a user to manipulate the position of at least some of said pieces so as to juxtapose said complementary boundaries of said pieces to construct said composite block, wherein the shape of said complementary boundaries varies with time such that, at any instant, said complementary boundaries between ones of said pieces corresponding to adjacent regions of said composite block have matching shapes.

2. The puzzle of claim 1, wherein said shape varies such that, at any instant, said complementary boundaries between ones of said pieces corresponding to adjacent regions of said composite block fit closely together.

3. The puzzle of claim 1, wherein said shape varies such that, if said complementary boundaries between ones of said pieces corresponding to adjacent regions of said composite block were to be placed together, said boundaries would feature a geometrical motif outlined by matching recesses progressing along said boundaries.

4. The puzzle of claim 3, wherein said geometrical motif itself varies with time.

5. The puzzle of claim 1, wherein said shape varies so as to correspond to a pattern traveling along said boundaries.

6. The puzzle of claim 1, wherein said shape is made up from a plurality of straight line segments.

7. A puzzle comprising:

(a) a display showing a plurality of pieces, each of said pieces corresponding substantially to a given region of a composite block, ones of said pieces corresponding to adjacent regions of said composite block having complementary boundaries which can be juxtaposed to form a composite block; and (b) an input device for allowing a user to manipulate the position of at least some of said pieces so as to juxtapose said complementary boundaries of said pieces to construct said composite block, wherein the shape of said complementary boundaries varies with time such that, at any instant, said complementary boundaries between ones of said pieces corresponding to adjacent regions of said composite block have matching shapes.

* * * * *